US011572994B2

(12) United States Patent
Floc'h et al.

(10) Patent No.: US 11,572,994 B2
(45) Date of Patent: Feb. 7, 2023

(54) HOMOGENEOUS LIGHT EMISSION AND LIGHT GUIDE ARRANGEMENT OF AN AUTOMOBILE VEHICLE FOR A UNIFORM LIT APPEARANCE

(71) Applicant: Valeo North America, Inc., Troy, MI (US)

(72) Inventors: Lionel Floc'h, Troy, MI (US); Michael Kratoska, Troy, MI (US); Ignacio Everardo Orozco, Troy, MI (US); Brant Potter, Troy, MI (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 16/714,723

(22) Filed: Dec. 14, 2019

(65) Prior Publication Data

US 2021/0180759 A1 Jun. 17, 2021

(51) Int. Cl.
*F21S 41/24* (2018.01)
*F21S 43/247* (2018.01)
(Continued)

(52) U.S. Cl.
CPC ..... *F21S 41/24* (2018.01); *F21S 41/148* (2018.01); *F21S 43/14* (2018.01); *F21S 43/241* (2018.01);
(Continued)

(58) Field of Classification Search
CPC ..... F21S 41/24; F21S 41/148; F21S 43/247; F21S 43/14; F21S 43/241
See application file for complete search history.

(56) References Cited

U.S. PATENT DOCUMENTS 6,305,813 B1 10/2001 Kekson et al.
7,639,918 B2 12/2009 Sayers et al.
(Continued)

FOREIGN PATENT DOCUMENTS

DE 19831002 A1 4/2000
DE 102017123669 A1 4/2018
EP 1832902 A1 9/2007

OTHER PUBLICATIONS

European Patent Office, International Search Report and Written Opinion of corresponding International Application No. PCT/US2020/064793, dated Apr. 1, 2021.

*Primary Examiner* — Diane I Lee
*Assistant Examiner* — Nathaniel J Lee
(74) *Attorney, Agent, or Firm* — Valeo North America, Inc.

(57) ABSTRACT

The subject inventive arrangement produces a light guide that may be of any curved shape that produces and obtains a lighting appearance of a uniform or homogenous lit appearance at the light exit face by using a single light source and a single light-reflective coupler. The present invention is premised on a light guide system that includes a light guide; a light source; and a coupler positioned at the light source that is configured to receive generated light. The coupler is adapted to produce a collimated light beam from the light source. A stepped reflective surface is formed along a light reflecting face of the light guide by a plurality of light reflective facets and a plurality of lateral surfaces, which are configured to receive and direct collimated light towards a light-emitting exit face. In addition, a number of light reflective facets are configured to collect collimated light at the light reflecting face's middle portion in intensity amounts less than collimated light at end portions of the light reflecting face.

11 Claims, 5 Drawing Sheets

(51) Int. Cl.

| | |
|---|---|
| ***F21S 43/14*** | (2018.01) |
| ***F21S 41/148*** | (2018.01) |
| ***F21S 43/241*** | (2018.01) |
| *F21Y 115/10* | (2016.01) |

(52) U.S. Cl.
CPC ..... *F21S 43/247* (2018.01); *F21Y 2115/10* (2016.08)

(56) References Cited

U.S. PATENT DOCUMENTS

| | | | | |
|---|---|---|---|---|
| 7,686,497 | B2 | 3/2010 | Kropac et al. | |
| 10,480,745 | B1 | 11/2019 | Li | |
| 2004/0264188 | A1* | 12/2004 | Tazawa | G02B 6/0038 257/E33.071 |
| 2009/0274419 | A1* | 11/2009 | Sayers | G02B 6/001 385/36 |
| 2012/0039082 | A1* | 2/2012 | Rodriguez Barros | B60R 1/1207 362/494 |
| 2015/0233539 | A1 | 8/2015 | Sagna et al. | |
| 2019/0154228 | A1* | 5/2019 | Xiang | F21S 43/249 |

* cited by examiner

HOMOGENEOUS LIGHT EMISSION AND LIGHT GUIDE ARRANGEMENT OF AN AUTOMOBILE VEHICLE FOR A UNIFORM LIT APPEARANCE

FIELD OF THE INVENTION

The present invention relates to automobile lighting or signaling devices, and more particularly, to automotive lighting or signaling devices with associated light guide units.

BACKGROUND

Efforts to improve the lighting efficiency and homogeneity in vehicle lamps is an on-going endeavor among Original Equipment Manufacturers (OEM) and numerous component/system suppliers. Of particular interest is the desire to obtain the lighting appearance of an enhanced homogeneous lit area or a uniform light emitting area by using a single light source. The present invention is directed to one such innovation solution to provide optical device arrangements that can produce enhanced homogenous-lit areas by using a single light source.

In the field of automotive lighting and light signalling units, it is becoming increasingly common to use light sources based on light-emitting semiconductor components, for example, light-emitting diodes (LEDs). The light emitted by an LED may, in any known suitable manner, be coupled with a light guide. Light guides are used in exterior vehicle lighting applications and in a variety of other applications. The light beam emitted by LEDs generally enter a light guide via an entry face and leaves the light guide through an exit face. Between the entry face and the exit face, LED produced light rays are guided within the light guide by typically using reflective elements positioned inside the light guide. Light guides may be curved or rectilinear. Light guides can be oriented vertically or horizontally, as well.

When the light guide is of a curved shape, it presents a difficult challenge to achieve uniform lit appearance at the light exit face. Furthermore, when the light guide is oriented vertically, it often presents a difficult challenge to position light sources to face an optical axis of the light guide because of packaging limitations. To typically address such shortcomings, conventional light guide systems employ multiple light sources and multiple couplers to increase homogeneity and to enhance the light emitting area in order to meet road regulation lighting or signal function requirements. However, using multiple light sources and couplers for performing such optical functions continues to present and remains a space constraint challenge in the design of automotive vehicle lighting devices.

Among the literature that may pertain to this technology includes patent documents: U.S. Pat. No. 7,639,918 B2 and U.S. Pat. No. 7,686,497 B2; U.S. Publication US 2015 0233 539 A1, all incorporated herein by reference for all purposes.

Thus among various objectives that this invention addresses, an objective is to achieve optical efficiency and enhanced light-effect control over alternatives that use optical film or diffusive materials where lighting effects are achievable at the expense of less desirable appearances. Another objective is to allow enhanced control of lighting effects versus meeting regulatory luminance intensity requirements. And another objective is to leverage single light source-single or minimized-light coupler arrangements within constrained light-guide space systems to efficiently impact uniform light distribution appearances at a lit exit face. And yet another objective is to achieve luminance photometric values of ninety percent (90%) or within ten percent (10%) luminance variation consistently across a light-emitting face or lit exit face. The invention herein overcomes one or more of these known problems and shortcomings in the design and implementation of the automotive field's associated light guide devices.

SUMMARY OF THE INVENTION

The present invention is directed to a unique solution to one or more of the problems discussed above. It is believed that that the present invention provides a motor vehicle light-signal unit arrangement and light guide assembly having a curvilinear formed light guide, which can still produce the appearances of an enhanced homogeneous lit area or a light emitting area by efficiently using a single light source and a single coupler or light-coupling reflector.

Accordingly pursuant to a first aspect of the present invention, a vehicle light guide assembly is contemplated for lighting or signaling that comprises: a light guide comprising a light-emissive body, a light emitting face side, and a light reflecting face which is disposed opposite to the light emitting face or exit face side; a light source, wherein a light emission axis of the light source is substantially perpendicular to an optical axis of the light guide; a coupler positioned at the light source and configured to receive a light beam emitted from the light source, wherein the coupler is adapted to produce a collimated light beam from the light source; wherein the light reflecting face of the light guide is a stepped reflective surface formed by a plurality of light reflecting facets and a plurality of lateral surfaces that are alternatively arranged on the light reflecting face of the light guide; wherein the plurality of reflecting facets are optically functional and are angled at substantially 45 degrees to the light emission axis from the coupler, and the plurality of lateral surfaces are optically non-functional and parallel to the light emission axis; wherein the plurality of reflecting facets are configured to receive the collimated light beam and said plurality of reflecting facets direct the collimated light beam towards the light emitting face along the optical axis, and wherein a number of light reflective facets are configured to collect a collimated light beam portion at a middle portion of the light reflecting face in an amount that is less than a collimated light beam portion from a number of reflective surfaces from end portions of the light reflecting face; and wherein the middle portion of the light reflecting face receives the collimated light beam and has a luminous intensity value that is higher than a luminous intensity value received on the end portions of the light reflecting face by the collimated light beam.

The invention may be further characterized by one or any combination of the features described herein, such as: wherein a width of the light guide progressively decreases in a curved, tapering or transitional manner from a light receiving face of the light guide towards a face that is opposite to the light receiving face; the light emitting face side or exit face is provided with a plurality of exit facets, which are arranged at step-wise right angles or are angled substantially at 90 degrees with respect to the optical axis of the light guide; wherein the collimated light beam that is directed towards the exit face or light emitting face side is angled 90 degrees with respect to the collimated light beam that is received on the plurality of light reflecting facets; wherein the light guide produces a light beam that is homogenous or evenly distributed along the light guide's exit face or light emitting face side; wherein a width of the light distributed on the light emitting face side is more wide as compared to a width of the light beam's spread from the light source; wherein the light source is positioned on a Printed Circuit Board (PCB); wherein the light source is of a Light Emitting Diode (LED) type; wherein the light source and the coupler are positioned proximal to the light receiving face; and wherein the light reflecting face of the light guide body conforms to an S-shape.

Accordingly pursuant to a second aspect of the present invention, a motor vehicle lighting or signalling device is contemplated comprising: a reflector assembly; a lens; a housing; and a light guide assembly, wherein the light guide assembly comprises: a light guide comprising a light-emissive body, an exit face or light emitting face side and a light reflecting face that is disposed opposite to the light emitting face side; a light source, wherein a light emission axis of the light source is substantially perpendicular to an optical axis of the light guide; a light-coupling reflector or coupler is positioned at the light source and configured to receive a light beam emitted from the light source, wherein the coupler produces a collimated light beam from the light source; wherein the light reflecting face of the light guide is a stepped reflective surface arrangement formed by a plurality of light reflecting facets and a plurality of lateral surfaces that are alternatively arranged on the light reflecting face of the light guide; wherein the plurality of reflecting facets are optically functional and are angled at substantially 45 degrees to the light emission axis from the coupler, and the plurality of lateral surfaces are optically non-functional and parallel to the light emission axis; wherein the plurality of reflecting facets are configured to receive the collimated light beam and said plurality of reflecting facets direct the collimated light beam towards the light emitting face along the optical axis, and wherein a number of light reflective facets are configured to collect a collimated light beam portion at a middle portion of the light reflecting face in an amount that is less than a collimated light beam portion from a number of reflective surfaces from end portions of the light reflecting face; and wherein the middle portion of the light reflecting face receives the collimated light beam and has a luminous intensity value that is higher than a luminous intensity value received on the end portions of the light reflecting face by the collimated light beam.

It should be appreciated that the above referenced aspects and examples are non-limiting, as others exist within the present invention, as shown and described herein.

DETAILED DESCRIPTION OF PREFERRED EMBODIMENTS

The present invention provides an automotive lighting and/or signalling device that can produce appearances of an enhanced homogeneous lit area or a light emitting area by efficiently using a single light source and a single coupler or single light-coupling reflector.

Figure 1B:
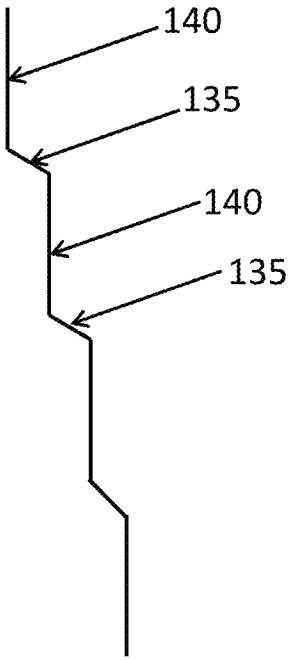
FIG. 1B shows an enlarged view of a portion of a light reflecting face of the light guide assembly shown in FIG. 1A, according to the present invention.
Figure 1A:
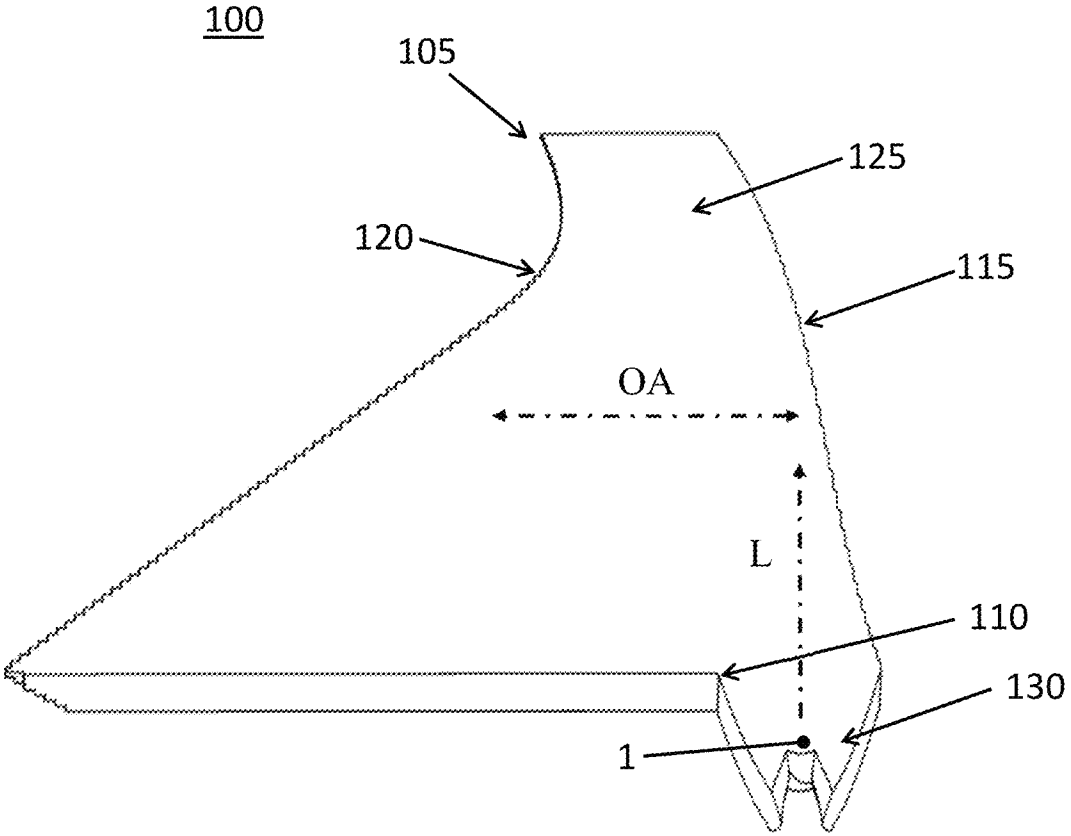
FIG. 1A shows a perspective view of a motor vehicle light guide assembly, according to the present invention.

Of particular interest and the main focus of the present disclosure is to provide a lighting system arrangement or a light guide assembly as shown in FIG. 1A. FIG. 1A shows a perspective view of a motor vehicle's light guide assembly, according to the present invention.

Unless defined otherwise, all technical and scientific terms used herein have the same meaning as commonly understood by one of ordinary skill in the art to which this technology belongs.

FIG. 1A shows light guide assembly 100 that comprises: a light guide 105 comprising a light receiving face 110, a light reflecting face 115, a light emitting face side or exit face 120, which is disposed opposite to light reflecting face 115; a light emissive body 125 coupling the light reflecting face 115 and light emitting face side 120; a light source 1 and a coupler 130.

It is contemplated that the relationships (e.g. at least the geometric properties and the material properties) between associated components and component assemblies are surprisingly important in solving one or more issues described in the background section above. Each of the components and component assemblies and their relationships are disclosed in greater detail and specifically in the following paragraphs.

Light Source 1

Light source represents a visually perceived source of electromagnetic radiation or an energized source of visually perceived radiant energy (inclusive of "Visible" light within the electromagnetic spectrum) but may include a broad combination or range of electromagnetic or radiant energy inclusive from among X-rays, ultraviolet and infrared energy, micro-wave and radio-wave spectrums. The light source may include every conventional and suitable lighting element sources such as filament-based or incandescent lamps, fluorescent lamps, arc or gas-discharge type lights, light emitting diodes (LED), or other suitable conventional sources.

The light source 1 preferably includes one or more Light Emitting Diodes (LEDs), however, other light sources may be used without falling outside the spirit and scope of the present invention. The light source is disposed at a predetermined point with respect to the light guide. The light source is positioned in such a way that light rays from the light source enter the light guide parallel to a longitudinal axis of the light guide. In an example, the light source is arranged on a printed circuit board (PCB) 133 (but not shown in the Figures). The PCB 133 is used to power, to control, and to carry the light sources. It will be noted that the light emission axis L from the light source 1 is perpendicular to an optical axis OA of the light guide 105. In an embodiment, the light source is positioned at a light receiving face 110 of the light guide 105 and in proximate to the light reflecting face 110.

Coupler 130

A coupler 130 or light-coupling reflector functions to gather surrounding generated light and distribute or redirect such associated generated light in a particular manner or tailored direction (a particular spot, location, randomized direction or a focused target area) using said coupler's reflective surface(s).

The coupler 130 is adapted to transmit the light from the source 1 towards the light guide 105. As shown in FIG. 1A, the light guide assembly 100 comprises a single coupler, which is positioned at the light receiving face 110 of the light guide 105. It will therefore be understood that the coupler 130 is associated with light receiving face 110 of the light guide 105. In an embodiment, coupler 130 is positioned proximate to the light reflecting face 115. In turn, a light ray's 145 travel distance between the coupler 130 and the light emitting face side 120 is more as compared to a light ray's 145 travel distance between the coupler 130 and the light reflecting face 115. Furthermore, the coupler's 130 reference axis is oriented in alignment with the longitudinal axis L direction illustrated for light guide 105 as depicted in FIGS. 1A and 3A. Coupler 130 may include collimating optics or a collimator (not shown in the Figures) to generate a collimated light beam 11. The coupler 130 is arranged to receive a light beam 145 from light source 1 and collimates the received light beam to generate the collimated light beam 11 such that light rays 145 enter the light guide 105 parallel to the longitudinal axis L referenced within light guide 105. In an embodiment, a width-thickness of the light-emissive body 125 of the light guide 105 may be the same as the coupler's 130 width-thickness. In an embodiment, the coupler 130 and the light guide 105 may be formed as a single piece. In another embodiment, the coupler 130 and the light guide 105 may be formed as two segregate pieces.

Light Guide 105

The Light guide 105, which may be a refined component of Light-emissive medium 125, functions as the material body that a light wave (inclusive of electromagnetic particle or varying-spectrum light waves) passes through. For example, light waves traveling through or passing-through a guiding material or a "medium" material. Light guide 105 may be constructed or formed from a unitized, integral or from a combination of constituent body components. Light-emissive medium 125 material may include rigid bodies or a material body of varying flexibility or a material body of relative elasticity or a gel-rubberized material. Light-emissive medium 105 may be formed from a simple geometric or customized shape and may include various colorant or additive features which may interfere with light transmission at various levels yet still allow for light transmission through the "medium" body at various degrees.

The light guide 105 takes the form of a sheet. The term 'sheet' is understood to mean a shape bounded in the direction of the thickness by two faces that are substantially parallel to over another over at least a part of the shape. The shape of the sheet itself may have a non-planar shape. The light guide 105 has an elongated light-emissive body 125 constructed of light-transmitting material. According to an embodiment of the present invention, the light guide is preferably made of a transparent plastic, by means of injection molding. As shown in FIG. 1A, light guide 105 may be curve-form, according to preferred embodiment of the present invention. In an embodiment, the light guide 105 may be monolithic or in other words—formed from a single piece from molding of plastic material, for example.

Light guide 105 comprises the light receiving face 110, the light-emissive body 125, the light reflecting face 115, and the light emitting face side or exit face 120 disposed opposite to light reflecting face 110. Light receiving face 110 is adapted to receive light rays 145 from the light source 1. In an embodiment, the light guide 105 may conform to an S-shape. However, the present invention is not limited to S-shape light guides. Rather according to the present invention, the light guide 105 can be of any curved shape which could produce a uniform or homogenous lit appearance by using a single coupler and a single light source.

In an embodiment, a width of the light guide 105 may progressively decrease in a curved manner from the light guide's light receiving face 110 to a face that opposes light receiving face 110.

Light reflecting face 115 is formed on a side surface of the light-emissive body 125. The light reflecting face 115 of light guide assembly 100 includes a stepped reflective surface (depicted FIG. 1B) formed by a plurality of light reflecting facets 135 and a plurality of lateral surfaces 140.

Light reflecting facets 135 and lateral surfaces 140 may be alternatively arranged along the side surface of the light-emissive body 125 spanning the longitudinal axis L direction, as shown in FIGS. 1A and 1B. The plurality of reflecting facets 135 are optically functional and include angled faces. Reflecting facets 135 are preferably angled at 45 degrees relative to light emission axis L aligned with the light source 1 but said reflecting facets may be oriented substantial to 45 degrees or oriented within a 42-48 degree range such that light rays incident thereon will possess total internal reflection (TIR) by the light reflecting facets 135 via light transmission back through the light-emissive body 125 and out of light guide 105 through the light emitting face side 120. In another embodiment, the light reflecting facets 135 may represent angled surfaces oriented at any other angle that would cause incident light rays to be TIR at the light reflecting face 115 when travelling in the direction of longitudinal axis L.

Furthermore, the plurality of lateral surfaces 140 are optically non-functional and parallel to light emission axis L, such that the lateral surfaces 140 typically do not reflect the light rays along Optical axis OA.

In an embodiment, the lengths of each reflecting facet 135 and the length of each lateral surface 140 may be the same along the longitudinal axis L direction of the light guide 105. In another embodiment, the lengths of each reflecting facet 135 and the length of each lateral surface 140 may be different and may vary along the longitudinal axis L direction of light guide 105.

Figure 2:
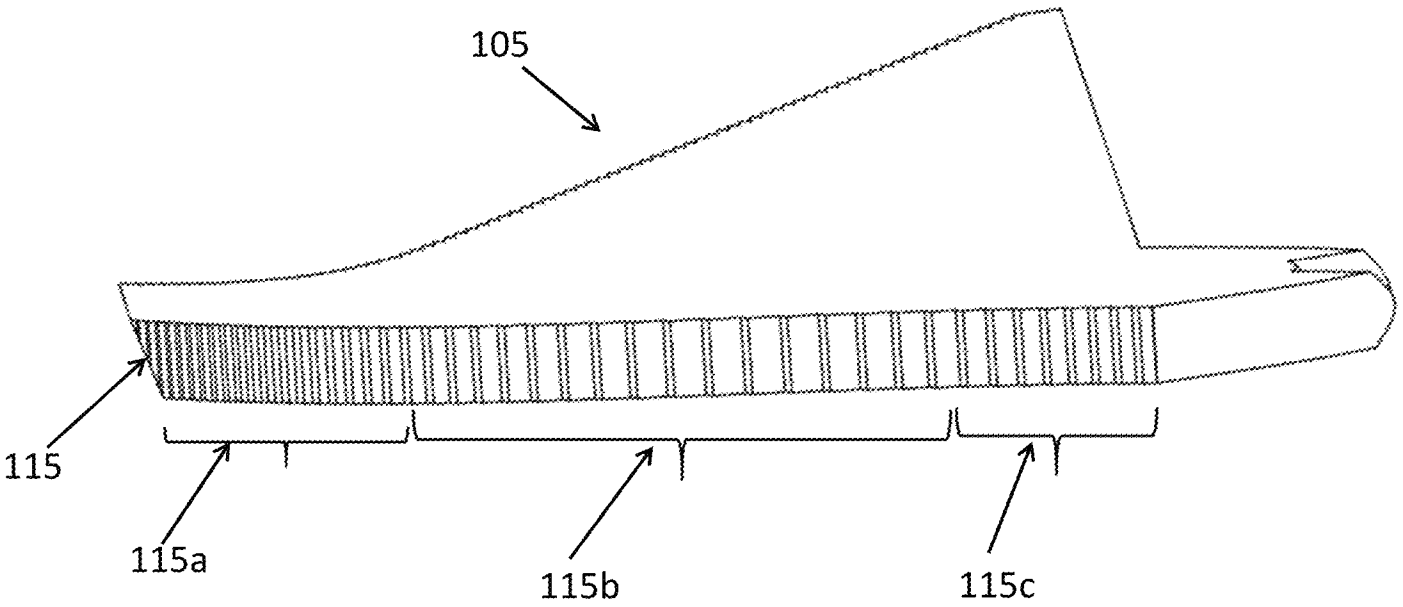
FIG. 2 shows a side view of the light guide assembly of FIG. 1A, according to the present invention.

In an embodiment, reflecting facets 135 and the lateral surfaces 140 are densely placed at end portions 115*a*, 115*b* of light reflecting face 115 when compared to the light reflecting face's middle portion 115*c*. As a result, a number of light reflective facets 135 are configured to collect a collimated light beam portion at the middle portion 115*c* in a luminous intensity amount that's less than a collimated light beam portion from a number of reflective facets 135 from end portions 115*a* and 115*b*, as from FIG. 2. Furthermore, middle portion 115*c* is configured to receive the collimated light beam with a luminous intensity value that is higher than a luminous intensity value received on end portions 115*a* and 115*b* by the collimated light beam. In an embodiment, the end portions 115*a*, 115*b* and the middle portion 115*c* may be the same length. In another embodiment, the middle portion 115*c* may have a longer dimension as compared to each end portions 115*a*, 115*b* length. Yet in another embodiment, both end portions 115*a*, 115*b* may each be the same length. Furthermore in another embodiment, both end portions 115*a*, 115*b* each may be different lengths.

In an embodiment, the light emitting face side 120 is adapted to receive a collimated light beam 11 from the light reflecting face 115. The collimated light beam 11 directed towards the light emitting face side 120 is angled 90 degrees with respect to the collimated light beam 11 that is received on the plurality of light reflecting facets 135. The light emitting face 120 is provided with a plurality of exit facets 150 along a longitudinal axis L. The plurality of exit faces 150 are angled 90 degrees with respect to the light guide's 105 optical axis OA and may be oriented substantial to 90 degrees. However, the present invention is not limited to facets angled at 90 degrees with respect to the optical axis OA of light guide 105. Furthermore, light emitting face or exit face 120 preferably includes facets formed in a stepwise facet arrangement 200, which may vary from course to fine step dimensions anywhere along the light emitting face 120 as suitably needed for tailoring luminous effects or manufacturing enhancements.

As a result of the above described light guide 105 and coupler 130 configuration, a light distribution width on the light emitting face side 120 is more than compared to the light beam distribution width spread from the light source.

Optical Axis OA

Optical axis OA functions as a reference axis line that defines the principal light path along which light propagates through an optical system along which there is some degree of rotational symmetry.

The term "optical axis" is used herein to refer to an imaginary line or plane that defines a path along which light propagates.

Longitudinal Axis L

Longitudinal axis L functions as a reference axis line that defines the principal light path from a single point light source 1 towards the target point direction along which the light propagates. The longitudinal axis is the direction in which collimated light rays are generally received in the light guide 105.

Figure 3B:
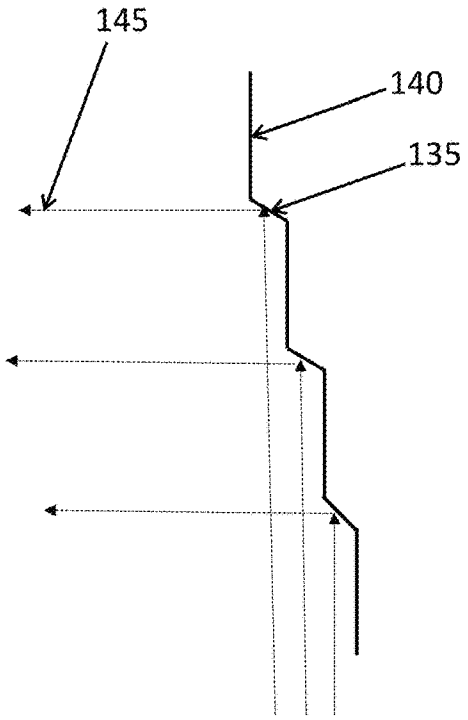
FIG. 3A and FIG. 3B illustrates the light guide assembly's operation with associated element features of FIG. 1A in further detail, according to the present invention.
Figure 3A:
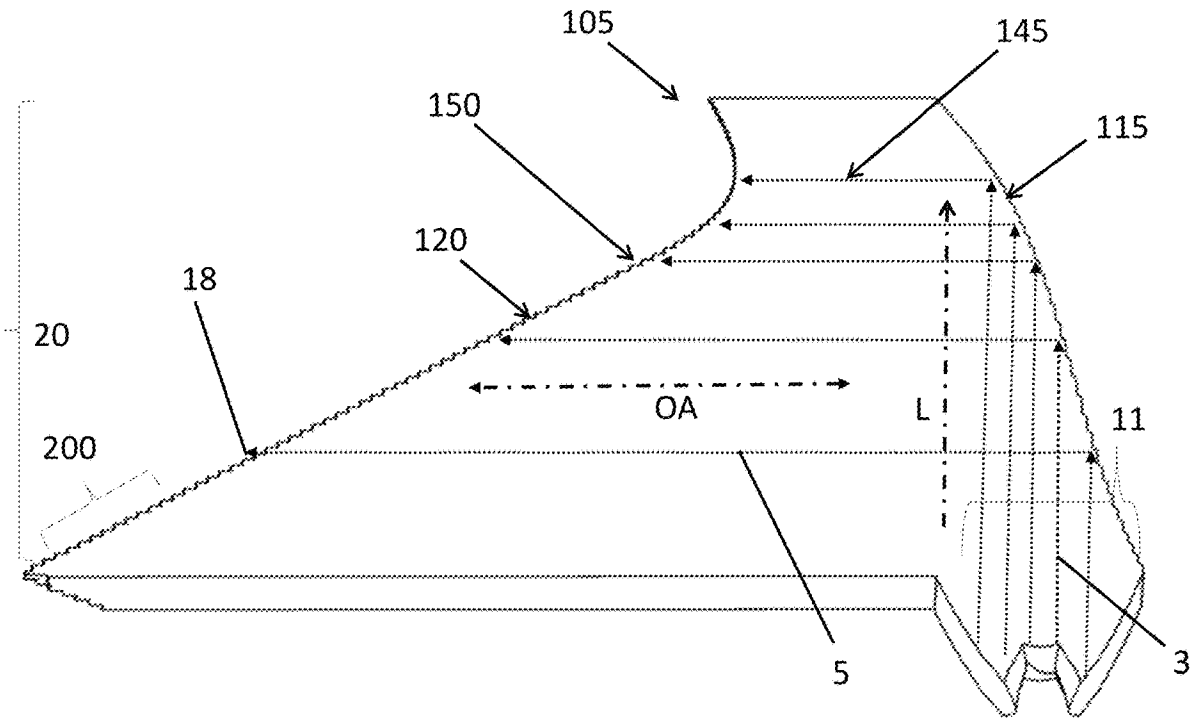
Figure 4:
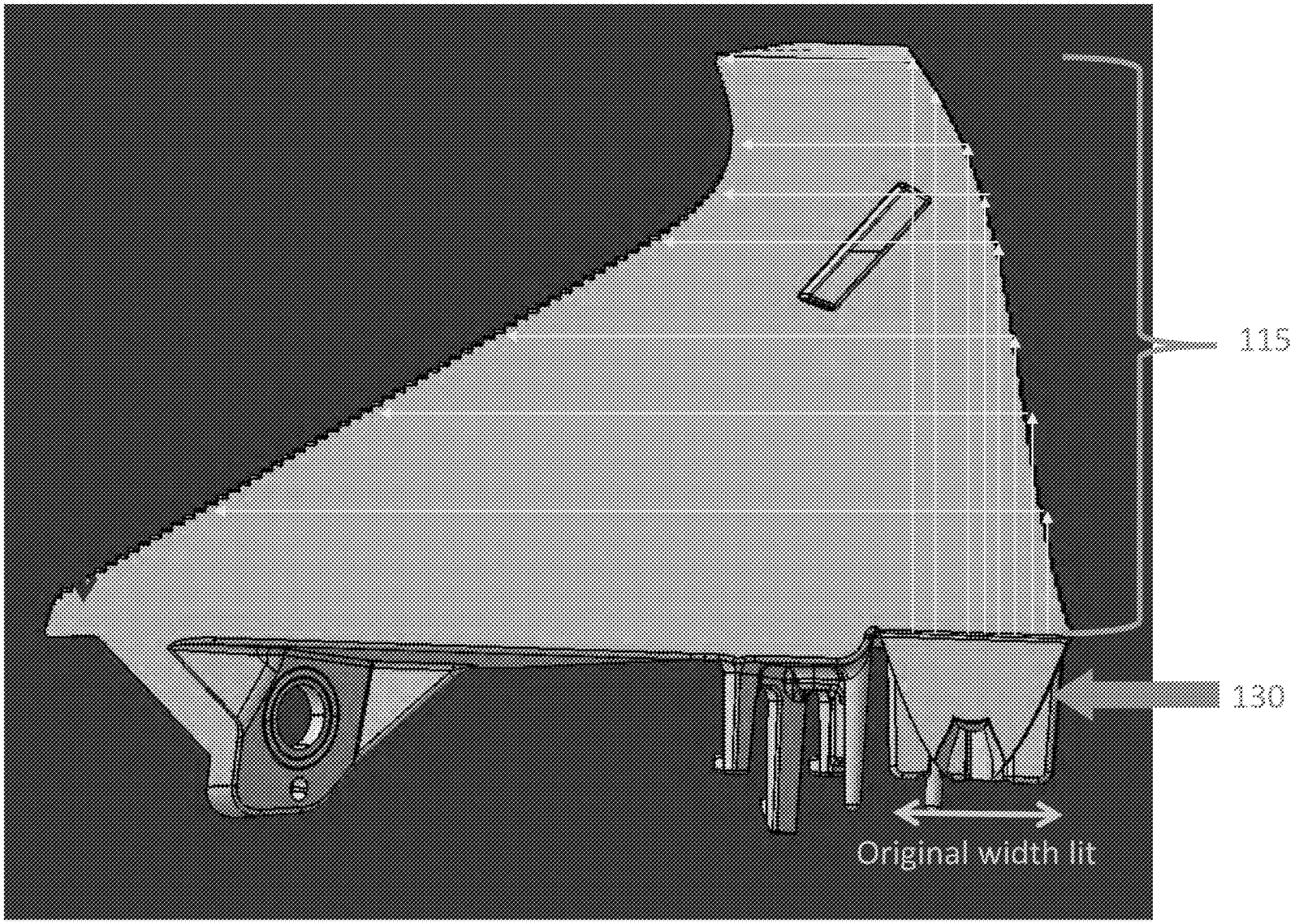
FIG. 4 depicts an exemplary producible light guide structure that achieves a homogenous-lit aspect at a light-emitting face and provides an illustration of associated light beam, coupler and light-reflective surface elements, according to the present invention.
Figure 5B:
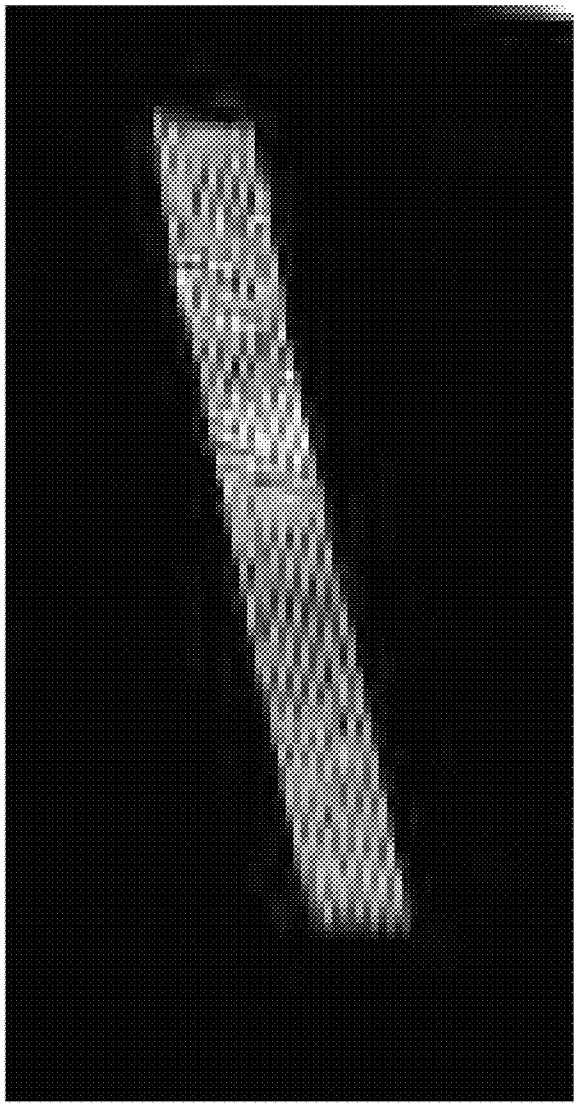
FIGS. 5A and 5B provide lit appearance results that depict realistic rendering (FIG. 5A) and luminance rendering (FIG. 5B) where good homogeneity or a uniform lit aspect are achieved at an exit face or light-emitting face side, according to the present invention.
Figure 5A:
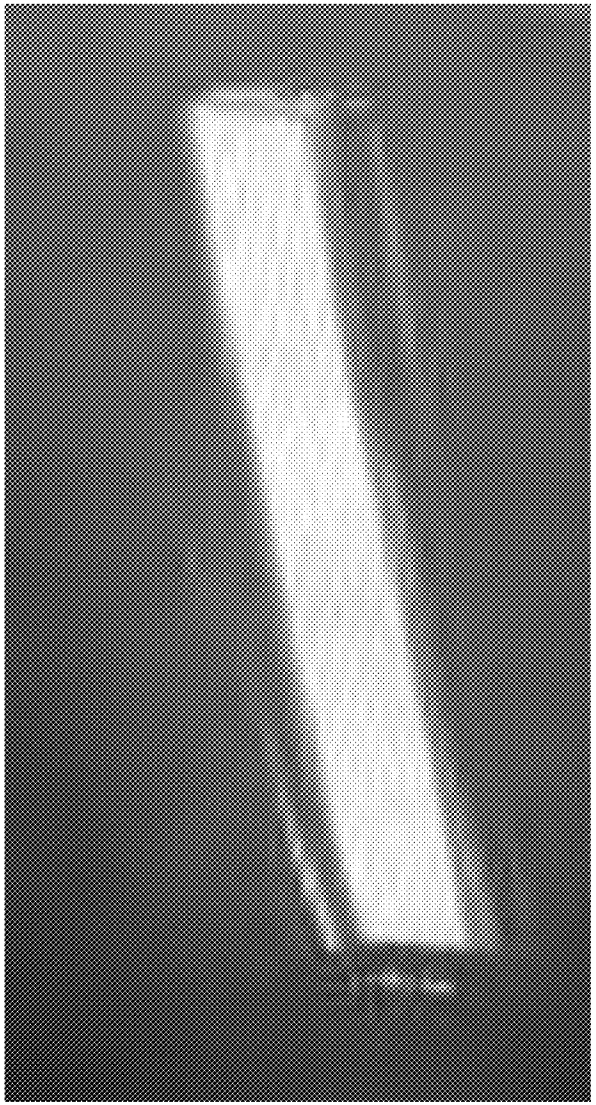

Operation of the light guide assembly 100 shown in the FIG. 1A is described in detail with respect to FIG. 3A and FIG. 3B. FIG. 3B shows a path of light rays 145 from a portion of light reflecting face 115. FIG. 3A shows a path of light rays 145 produced during the operation of light guide assembly 100 depicted in associated illustrations according to the present invention. The path of the light rays is shown in a general manner by reference numeral 145.

In operation, the light rays or the light beam 145 emitted by the light source 1 are collimated by the coupler 130 to generate a collimated light beam 11. The collimated light beam 11 is then transmitted towards the light reflecting face 115 along the longitudinal axis L of the light guide 105. Light reflecting facets 135 are adapted to receive the collimated light beam and directs the collimated light beam 11 towards the light emitting face side or exit face 120 of the light guide 105 via the light-emissive body 125 of light guide 105. In an embodiment, these reflecting facets 135 are angled at substantially 45 degrees such that light rays incident thereon will be totally internally reflected by the light reflecting facets 135 back through the light-emissive body 125 and out of the light guide 105 through the light emitting face side 120 of light guide 105.

As previously discussed, the middle portion 115*c* of the light reflecting face 115 is configured to receive the collimated light beam and has a luminous intensity value that is higher than a luminous intensity value received on the end portions 115*a*, 115*b* of the light reflecting face 115 by the collimated light beam. Thus by receiving collimated light beams of varying luminous intensities at different portions of the light reflecting face 115, the light beam is evenly distributed along the light emitting face side 120 of the light guide 105.

Therefore with the present inventive light guide assembly 105, a light beam that is homogenous or evenly distributed at the curved shaped light guide along the light emitting face or exit face 120 is produced by using the single coupler and the light source.

Although the present disclosure is provided with reference to figures, all of the embodiments shown in figures are intended to explain the preferred embodiments of the present invention by ways of examples, instead of being intended to limit the present invention.

It should be appreciated by those skilled in the art that various changes or modifications may be made in the present disclosure without departing from the principles and spirit of the inventive disclosure, which are intended to be covered by the present invention as long as these changes or modifications fall within the scope defined in the claims and their equivalents.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values, which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the end points. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes.

The term "consisting essentially" of to describe a combination shall include the elements, ingredients, components or steps identified, and such other elements ingredients, components or steps that do not materially affect the basic and novel characteristics of the combination.

LIST OF ELEMENT NUMBERS

Collimated Light Beam 11
Coupler 130
Light Source 1
Light ray from light source to light-reflecting face 3
Light ray from light reflecting face to light-emitting face 5
Luminance intensity or photo-metric value at exit facet 18
Luminance intensity or photo-metric value at 120 or exit face 20

Light Guide Assembly 100
Light Guide 105
Light Rays or Light Beam 145
Light receiving face 110
Light reflecting face 115
Light emitting face side 120
Light-emissive body 125
Longitudinal axis L
Optical axis OA
Printed Circuit Board (PCB) 133
Plurality of reflecting facets 135
Plurality of lateral surfaces 140
End portions of the light reflecting face 115*a* 115*b*
Middle portion of the light reflecting face 115*c*
Plurality of exit facets 150
Step-wise facet arrangement 200

The invention claimed is:

1. A light guide assembly of a vehicle for lighting or signaling, comprising:

a single light source wherein a light emission axis of said light source is substantially perpendicular to an optical axis of the light guide;

a coupler positioned at said light source and configured to receive a light beam emitted from said light source, wherein the coupler is adapted to produce a collimated light beam from said light source;

a light guide comprising:

a light-emissive body, a light receiving face side, a light emitting face side of a parabolic curvature, a light reflecting face side and a top face side, the light reflecting face side being disposed opposing the light emitting face side;

wherein the top face and light receiving face sides are substantially parallel to one another and both disposed between the light reflecting and the light emitting faces, wherein an entire profile of the light reflecting face is bounded within a width of the coupler, wherein the light emitting face is offset entirely outside of the width of the coupler;

wherein the light reflecting face of the light guide includes a curvilinear S-shape comprising a stepped reflective surface formed by a plurality of light reflecting facets and a plurality of lateral surfaces that are alternatively arranged on the light reflecting face of the light guide;

wherein the plurality of reflecting facets are optically functional and are angled at substantially 45 degrees to the light emission axis from the coupler, and the plurality of lateral surfaces are optically non-functional and parallel to the light emission axis;

wherein the plurality of reflecting facets are configured to receive the collimated light beam and said plurality of reflecting facets direct the collimated light beam towards the light emitting face along the optical axis;

wherein the collimated light beam that is directed towards the light emitting face side, which includes a number of right-angled exit facets all-along said light emitting face, is angled 90 degrees with respect to the collimated light beam that is received on the plurality of light reflecting facets; and wherein the light guide produces a light beam that is homogenous or evenly distributed along the light guide's light emitting face side.

2. The light guide assembly according to claim 1, wherein a width of the light guide progressively decreases in a curved manner from a light receiving face of the light guide to a face that is opposite to the light receiving face.

3. The light guide assembly according to claim 2, wherein said light source and the coupler are positioned proximal to the light receiving face.

4. The light guide assembly according to claim 1, wherein the light emitting face side is provided with a plurality of exit facets, which are substantially angled at 90 degrees with respect to the optical axis of the light guide.

5. The light guide assembly according to claim 1, wherein the light guide produces a light beam that is homogenous or evenly distributed along the light emitting face side of the light guide.

6. The light guide assembly according to claim 1, wherein a width of the light distributed on the light emitting face side is more compared to a width of the spread of the light beam from said light source.

7. The light guide assembly according to claim 1, wherein said light source is positioned on a Printed Circuit Board (PCB).

8. The light guide assembly according to claim 1, wherein said light source is of a Light Emitting Diode (LED) type.

9. The light guide assembly according to claim 1, wherein the light reflecting face of the light guide body conforms to an S-shape.

10. The light guide assembly according to claim 1, wherein a number of light reflective facets are configured to collect a collimated light beam portion at a middle portion of the light reflecting face in an amount that is less than a collimated light beam portion from a number of reflective facets from a number of end portions of the light reflecting face; and wherein the middle portion of the light reflecting face receives the collimated light beam and has a luminous intensity value that is higher than a luminous intensity value received on the end portions of the light reflecting face by the collimated light beam.

11. A lighting or signaling device of a motor vehicle comprising:

a single light source, wherein a light emission axis of said light source is substantially perpendicular to an optical axis of the light guide;

a coupler positioned at said light source and configured to receive a light beam emitted from said light source, wherein the coupler to produces a collimated light beam from said light source;

a reflector assembly;

a lens;

a housing; and a light guide assembly, wherein the light guide assembly comprises:

a light guide comprising a light-emissive body, a light receiving face, a light emitting face of a parabolic curvature, a light reflecting face, and a top face side, the light reflecting face side being disposed opposing the light emitting face side;

wherein the top face and light receiving faces are both disposed between the light reflecting and the light emitting faces, wherein an entire profile of the light reflecting face is bounded within a width of the coupler, wherein the light emitting face is offset entirely outside of the width of the coupler;

wherein the light reflecting face of the light guide includes a curvilinear S-shape comprising a stepped reflective surface formed by a plurality of light reflecting facets and a plurality of lateral surfaces that are alternatively arranged on the light reflecting face of the light guide;

wherein the plurality of reflecting facets are optically functional and are angled at substantially 45 degrees to the light emission axis from the coupler, and the plurality of lateral surfaces are optically non-functional and parallel to the light emission axis;

wherein the plurality of reflecting facets are configured to receive the collimated light beam and said plurality of reflecting facets direct the collimated light beam towards the light emitting face along the optical axis;

wherein the collimated light beam that is directed towards the light emitting face side includes a number of right-angled exit facets all-along said light emitting face; and wherein the light guide produces a light beam that is homogenous or evenly distributed along the light guide's light emitting face.

* * * * *